United States Patent [19]

Jay, Sr. et al.

[11] Patent Number: 5,024,245

[45] Date of Patent: Jun. 18, 1991

[54] PNEUMATIC DESEDIMENTATION MACHINE IMPROVEMENT

[76] Inventors: Jerry L. Jay, Sr., Rte. #3, Box 239, Newbern, Tenn. 38059; William R. Holifield, III, 1001 Brentwood Pl., Nashville, Tenn. 37211

[21] Appl. No.: 448,238

[22] Filed: Dec. 11, 1989

[51] Int. Cl.[5] ..... B08B 9/02

[52] U.S. Cl. ..... 134/108; 134/169 R

[58] Field of Search ..... 134/168 R, 169 R, 169 A, 134/108

[56] References Cited

U.S. PATENT DOCUMENTS 1,918,048 7/1933 Marxman ..... 134/168 R
3,915,179 10/1975 Casson ..... 134/45
4,785,836 11/1988 Yamamoto ..... 134/170 X
4,858,632 8/1989 Jay, Jr. et al. ..... 134/169 R X

*Primary Examiner*—Philip R. Coe

[57] ABSTRACT

The Pneumatic desedimentation machine improvement is designed to provide a continuous recirculating system by which a fixed volume of solvent or acid solution can be recirculated through a closed remote system such as machinery, equipment, or any other system where sedimentation occurs, for the purpose of removing the sedimentation in a safe and efficient manner which is accomplished by the controlled and compensated flow of solvents or solutions out of the reservoir and through any remote system by applied air pressure in a controlled recirculating manner and at a controlled temperature for maximum efficiency of the solution being used.

2 Claims, 2 Drawing Sheets

PNEUMATIC DESEDIMENTATION MACHINE IMPROVEMENT

BACKGROUND OF THE INVENTION

Industry has long had a problem with calcium and mineral deposits which form on the inside of water heating and/or cooling systems, and other systems where sedimentation may occur, that inhibit their efficiency and if left unchecked can render some equipment and/or machinery completely unusable, so it is necessary to periodically remove this sedimentation from the inside of machinery, equipment, and plumbing systems which has traditionally been accomplished by providing a reservoir of acid, solvent, or solution with positive displacement recirculating pump systems, which can create a hazard to workers and/or equipment.

Because of the high pressures and velocities that can occur with fixed volume pumps through severe restrictions, hoses, and/or other plumbing can rupture—potentially spraying workers and/or equipment with strong acids or solvents which can injure workers and damage equipment. Further still, with currently available systems, it is difficult to make them 100% explosion-proof, which has become a necessary requirement for some industrial settings.

Further still, if sedimentation is severe enough, it can restrict the flow to such a point that the pressures and velocities of the solutions used, can reach such a point, when a positive displacement pump system is used, it can score or cut through water jackets in equipment and/or machinery creating a hazard and rendering the equipment and/or machinery useless.

It is therefore among the objects of this invention to provide a new and improved way to remove deposits from the inside of remote equipment, machinery, or systems which is safe to workers, equipment, and machinery.

It is also among the objects of this invention to provide a new and improved method to remove deposits from the inside of remote machinery, equipment, or systems that can readily be made explosion-proof and so:

SUMMARY OF THE INVENTION

The Pneumatic Desedimentation Machine Improvement will provide for a safe, reliable, and efficient means of removing deposit from the inside of remote equipment, machinery, or systems, and perform the same basic function as the pneumatic Desedimentation Machine, U.S. Pat. No. 4,858,632 as previously patented, its design allows for the controlled, low velocity, low pressure, automatically compensated flow of solutions or solvents through remote systems to provide for the maximum exposure time between the solutions or solvents so that the maximum neutralizing effects can be achieved.

The Pneumatic Desedimentation Machine Improvement can be provided with a heating system so that it may be used with solutions that may be more efficient at higher temperatures. The temperature can be maintined that provides for maximum efficiency.

The Pneumatic Desedmentation Machine Improvement allows it to be made explosion-proof more easily than the Pneumatic Desedimentation Machine as previously patented due to the fact that the Pneumatic Desedimentation Machine as previously patented, still requires electrical controls to operate the level controls and solenoids for reciprocation, and in the event the device is used with strong solvents that may be extremely flammable, these electrical controls can be a hazard.

The Pneumatic Desedmentation Machine Improvement, when used in conjunction with strong solvents, which does not require heat as a catalyst, can have the heating elements removed, thereby making it totally pneumatic, eliminating the spark hazard created by electrical circuits, but when used in conjunction with other solutions the heat circuit may be added to provide for the maximum efficient temperature of the solution used.

With these and other objects in view, the invention consists in its construction, arrangement, and combination of the various parts of the device, whereby the objects contemplated are attained, as hereinafter set forth, and pointed out in the following description in the accompanying drawings.

DESCRIPTION OF PREFERRED EMBODIMENTS

Figure 4:
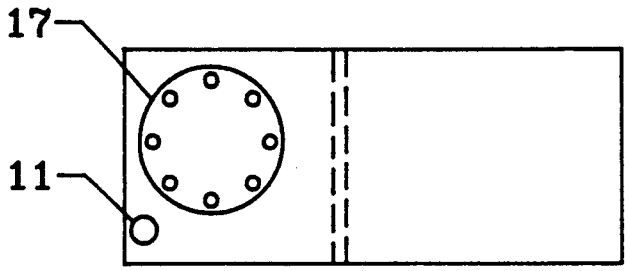
FIG. 4 shows the top exterior view of the apparatus.
Figures 1, 2:
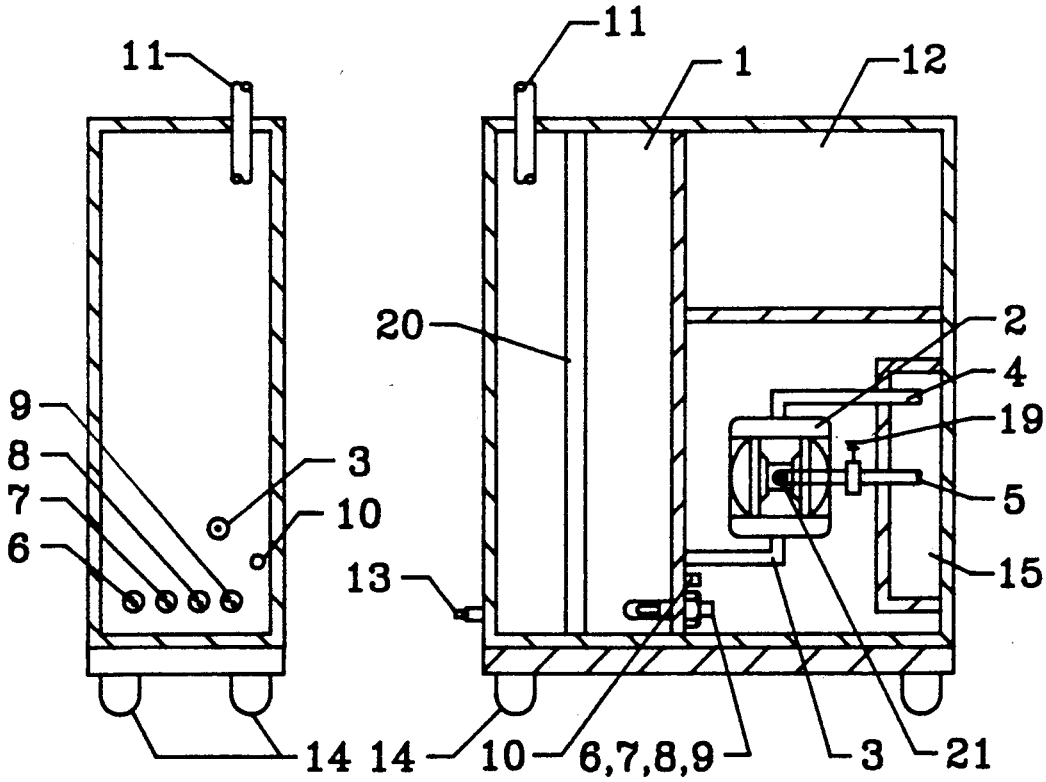
FIG. 1 shows front perspective view of the apparatus with cutaway view of internal arrangements.
FIG. 2 shows left end perspective view of the apparatus with cutaway view of internal arrangements.
Figure 3:
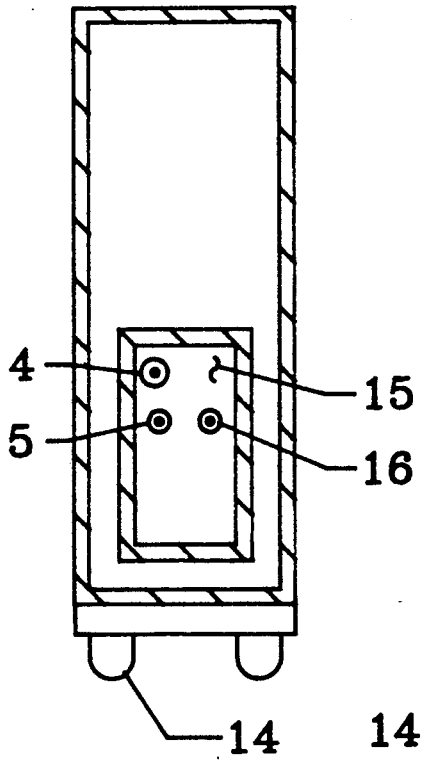
FIG. 3 shows right end exterior of the apparatus demonstrating the external connections.
Figure 5:
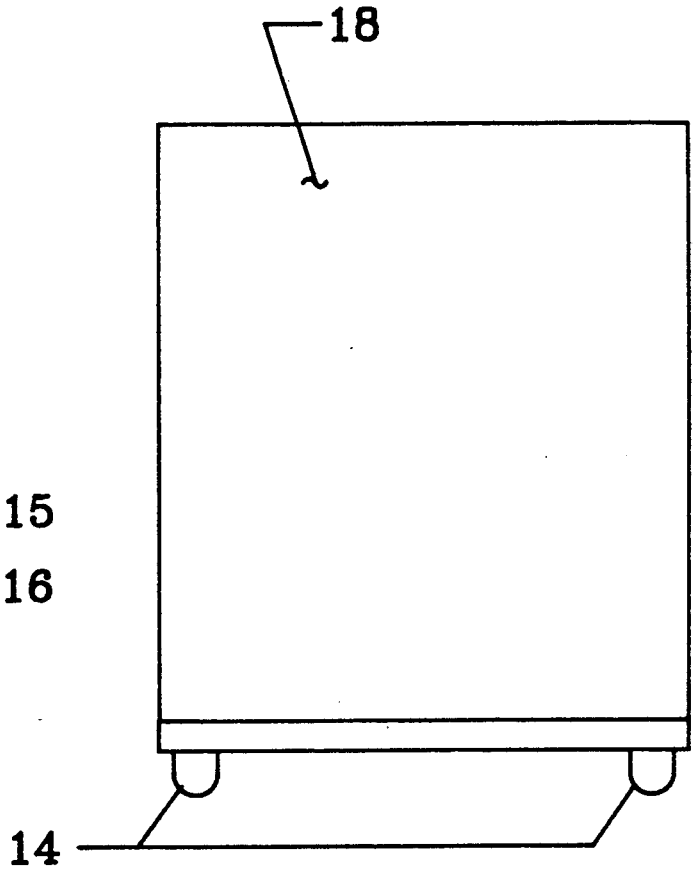
FIG. 5 shows rear exterior view of the apparatus.

The apparatus is comprised mostly of a reservoir (1) which is designed to hold the solution or solvent being used in the desedimentation process which is connected to the pump (2) by the pump supply line (3), the pump being of a pneumatic type so that it can be powered by any external source of compressed air attached to the air inlet (5) and controlled by the action of the Air Pressure Relief Valve (19) so that it becomes self compensating to the changes in flow rates because of the action of the Pressure Relief Valve (19) which will maintain preset pressure to the air pressure input of the pneumatic pump (2). Due to the nataure of pneumatic pumps the ratio of input to output is 1 to 1. Therefore, by regulating the input pressure by the action of the Air Pressure Relief Valve (19) we also regulate the pressure of solution going out of the To Process Line (4) in direct proportion and the velocity will be simultaneously compensated because as the desedimentation occurs the restriction will be less so that the Air Pressure Relief Valve (19) will automatically allow more air to pass through to maintain the preset pressure thereby allowing for total volume and pressure compensation of the solutions or solvents being pumped through the To Process Line (4).

The air being used as a motive force is exhausted through the Air Exhaust Line (16). The Reservoir (1) is also supplied with a drain plug (13) for user convenience and a sight gauge (20) so that solution or solvent level may be observed.

The solution or solvent is placed in the reservoir (1) through the filler cap (17) where, in the event it is an acid solution, it may be heated to the maximum efficient temperature by the action of the heater elements, (6), (7), (8), and (9), and maintained at a preset temperature by utilizing the temperature probe (10).

The heating elements and temperature probe can readily be operated by conventional electrical controls which can be placed in the area (12) left blank for electrical controls or storage, where in the event that it is a solvent being used for the desedimentation process that may be flammable.

The heating elements and electrical controls may be eliminated so the system becomes totally pneumatic and explosion-proof and this area (12) can be used for storage.

When the solution, or solvent, is place into the reservoir (1) and a remote, user supplied, compressed air source is applied to the Air Inlet Line (5), the pneumatic pump will cause the solution to be pumped from the reservoir (1) through the Pump Supply Line (3) and out of the To Process Line (4) and through user supplied plumbing to any remote equipment, machinery or system to be cleaned, in a volume and pressure compensated manner, through the action of the Air Pressure Regulator (19), and back to the Process Solution Return Line (11) by user supplied plumbing, where it is deposited back into the reservoir so that a continuously recirculating system is provided.

The apparatus can also be supplied with feet, legs, or casters (14) for user convenience and a reset area for external connections (15).

The back of the apparatus is left blank and constitutes only a bulkhead (18).

Having described and illustrated the invention in what is believed to be a clear and accurate manner what is claimed in support of Letters Patent is:

1. A device for the removal of deposits from the inside of remote machinery, equipment, or system where sedimentation may occur, by providing a constant flow of solvent or solution through the machinery equipment or system in an automatically compensated manner comprising: a reservoir supplied with heating elements for controling the temperatuare of the solution, or solvent, in the reservoir and interconnecting plumbing which connects the reservoir to a solution return line and a fluid input side of a pneumatic pump, the pump having an air inlet line connected to the air inlet side of the pump; the air inlet line being provided with an air pressure relief valve; the pump also being provided with a to process line which is connected to the fluid output side of the pump and an air outlet line which is connected to the air outlet side of the pump so that by connecting the to process line, by means of user supplied plumbing, to the fluid input side of any remote machinery, equipment, or system being cleaned, and connecting the fluid output side of the machinery, equipment, or system to the solution return line on the reservoir, by means of user supplied plumbing, and with user supplied compressed air supplied to the air inlet line, solution can be placed in the reservoir, heated to its most efficient temperature and pumped out of the reservoir, to, and thru the remote machinery, equipment or system being cleaned and back to the reservoir in a continuous and controlled manner, in which the pressure and volume of the solvent or solution is automatically compensated by the action of the air pressure relief valve, which will allow more or less air to pass through to the air inlet side of the pump to maintain a preset pressure that is established by adjusting the air pressure relief valve to the desired working pressure.

2. A device as in claim 1 in which the heating elements may be removed or discontinued to provide for explosion-proof operation.

* * * * *